US006163105A

United States Patent [19]

Park et al.

[11] Patent Number: 6,163,105

[45] Date of Patent: Dec. 19, 2000

[54] ELECTRON GUN WITH SPECIFIC GRID ELECTRODES

[75] Inventors: In-kyu Park; Yoo-seon Kim, both of Kyungki-do, Rep. of Korea

[73] Assignee: Samsung Display Devices Co., Ltd., Syungki-do, Rep. of Korea

[21] Appl. No.: 09/169,691

[22] Filed: Oct. 9, 1998

[30] Foreign Application Priority Data

Dec. 10, 1997 [KR] Rep. of Korea ..... 97-67365

[51] Int. Cl.[7] ..... H01J 29/46

[52] U.S. Cl. ..... 313/460; 313/414; 313/446

[58] Field of Search ..... 313/414, 412, 313/441, 446, 447, 460

[56] References Cited

U.S. PATENT DOCUMENTS 5,220,239 6/1993 Chen ..... 313/448
5,397,959 3/1995 Takahashi et al. ..... 313/414

*Primary Examiner*—Vip Patel
*Attorney, Agent, or Firm*—Christie, Parker & Hale, LLP

[57] ABSTRACT

An electron gun for a cathode ray tube includes a triode portion composed of a cathode, a first grid electrode and a second grid electrode. Each of the first and second grid electrodes has beam-guide holes. The beam-guide hole of the first grid electrode is larger than the beam-guide hole of the second grid electrode. The hole portion of the first grid electrode is thinner than the hole portion of the second grid electrode. The distance between the first grid electrode and the second grid electrode is two or three times greater than as the distance between the cathode and the first grid electrode.

7 Claims, 3 Drawing Sheets

ELECTRON GUN WITH SPECIFIC GRID ELECTRODES

CROSS REFERENCE TO RELATED APPLICATION

This application is based on application No. 97-67365 filed in Korean Industrial Property Office on Dec. 10, 1997, the content of which is incorporated hereinto by reference.

FIELD OF THE INVENTION

The present invention relates to an electron gun for a cathode ray tube (CRT) and, more particularly, to an electron gun for a CRT having a triode portion composed of a cathode, a first grid electrode and a second grid electrode.

BACKGROUND OF THE INVENTION

Generally, CRTs are designed to reproduce the original picture image on a glass screen by receiving the picture image signals from the external and exciting phosphors coated on the screen with electron beams emitted from the electron gun in accordance with the signals.

The electron gun is formed with a triode portion composed of a cathode and first and second grid electrodes, and other focusing and accelerating electrodes. The electrode components are provided with beam-guide holes arranged in line with the cathode.

Thermal electrons emitted from the cathode pass through the first and second electrodes while forming an electron beam. The electron beam is then focused and accelerated through the focusing and accelerating electrodes to thereby land on the screen.

The triode portion of the electron gun acts as a critical factor for a cutoff voltage characteristic and a current density distribution. That is, the electron beam emission efficiency of the electron gun is determined by the geometrical structure of the triode portion and the voltage applied thereto.

In the triode assembly, the hole size and the hole portion thickness of the first grid electrode, the distance between the cathode and the first grid electrode, and the distance between the first and second grid electrodes are largely influential to the electron beam emission efficiency. Particularly when the hole size of the first grid electrode is smaller, the electron beam emission efficiency becomes lowered.

FIG. 3 is a cross sectional view showing main components of an electron gun according to a prior art. As shown in FIG. 3, the electron gun has a triode portion composed of a cathode 24, a first grid electrode 20 and a second grid electrode 22. The electrode components 20 and 22 are provided with beam-guide holes 20*a* and 22*a* respectively. The hole 20*a* of the first grid electrode 20 is usually formed with a diameter smaller than or identical with that of the hole 22*a* of the second grid electrode 22.

However, in such a state, the emission radius of the electron beam 26 is liable to be changed when the driving voltage applied to the cathode 24 varies. When the electron beams 26 pass through apertures of the shadow mask (not shown) with seriously changed emission radii, they are liable to be interfering with neighboring electron beams and generating a so-called moire phenomenon. The moire phenomenon results in spurious patterns in the reproduced picture images.

In order to overcome the above defects, Japanese Patent Laid Open Publication No. Sho 63-266736 discloses an electron gun with a first grid electrode having a beam-guide hole larger than that of a second grid electrode with increased thickness sufficient for maintaining a good cutoff voltage characteristic.

However, in the above technique, the increased thickness of the beam-guide hole portion of the first grid electrode makes it difficult to prevent the change of the electron beam size pursuant to the change of the cathode driving voltage. That is, the emission radius as well as the current density of the electron beam decreases with the increased thickness of the first grid electrode because the voltage applied to the second grid electrode does not effectively reach the electron emission area of the cathode. Therefore, when the driving voltage of the cathode is changed to display various patterns on the screen, the electron beam size becomes seriously changed due to the weak current density and, as a result, the electron beam lands on the screen with random spot sizes.

SUMMARY OF THE INVENTION

It is an object of the present invention to provide an electron gun for a CRT realizing a uniform beam spot size on a screen with a high current density.

In order to achieve this object and others, the electron gun for a CRT according to one aspect of the present invention includes a triode portion composed of a cathode, a first grid electrode and a second grid electrode. Each of the first and second grid electrodes has beam-guide holes. The beam-guide hole of the first grid electrode is larger than the beam-guide hole of the second grid electrode. The hole portion of the first grid electrode is thinner than the hole portion of the second grid electrode. The distance between the first grid electrode and the second grid electrode is two or three times the distance between the cathode and the first grid electrode.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawing, wherein.

DETAILED DESCRIPTION OF THE PREFERRED EMBODIMENT

Reference will now be made in detail to the preferred embodiments of the present invention, examples of which are illustrated in the accompanying drawings.

Figure 1:
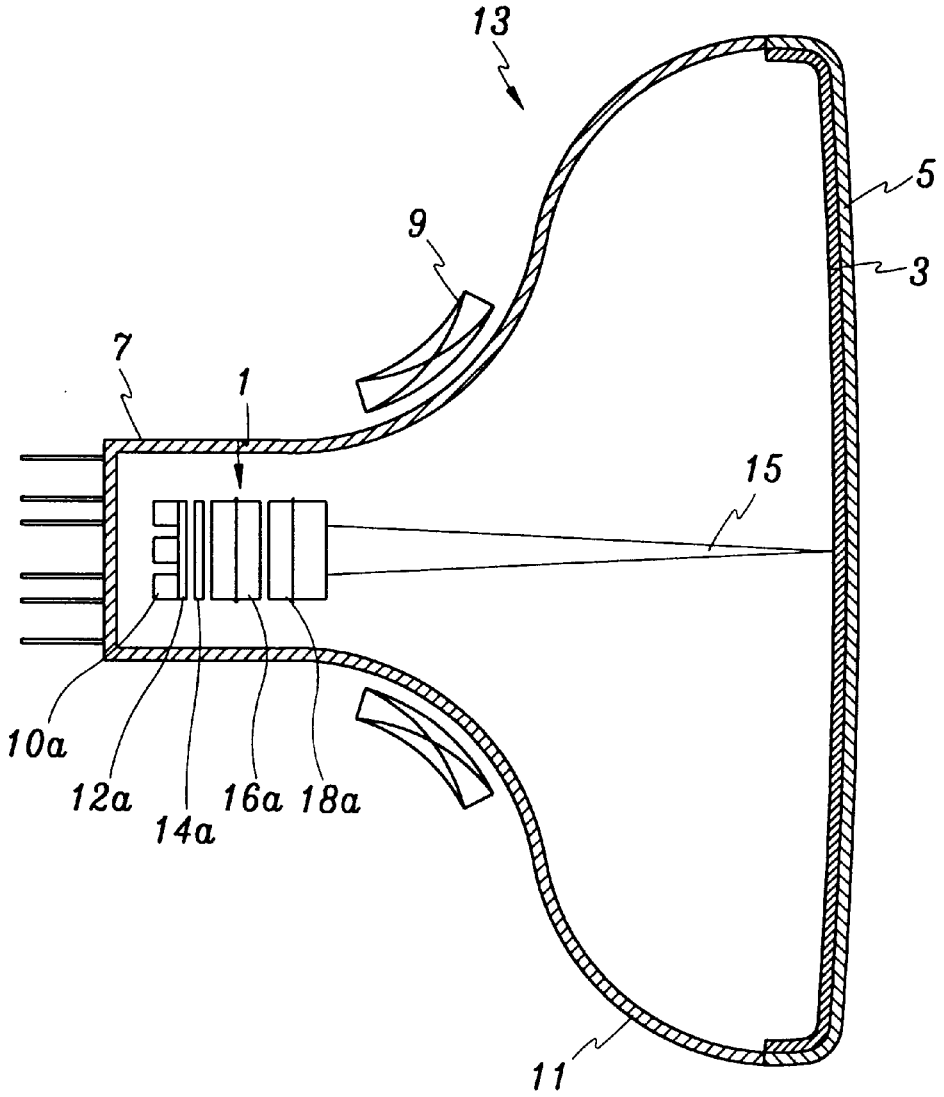
FIG. 1 is a schematic sectional view showing a CRT with an electron gun according to a preferred embodiment of the present invention.
Figure 2:
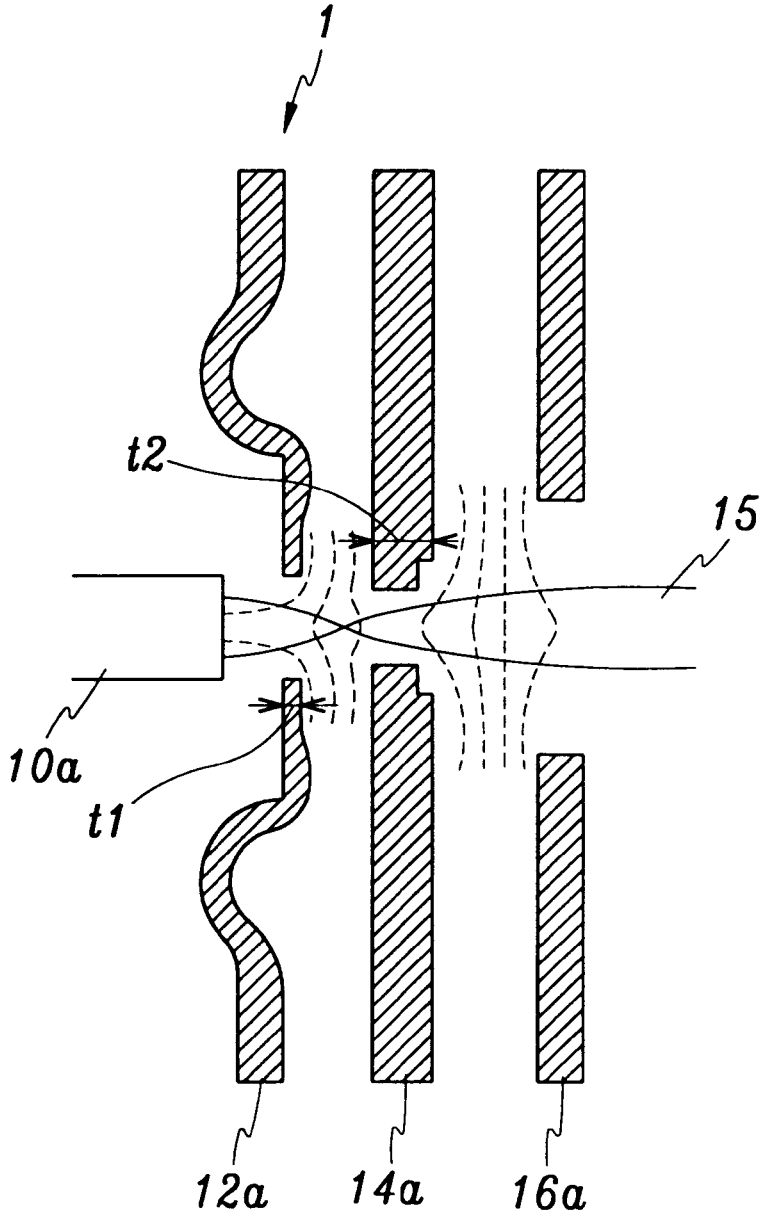
FIG. 2 is a cross-sectional view of the electron gun of FIG. 1.
Figure 3:
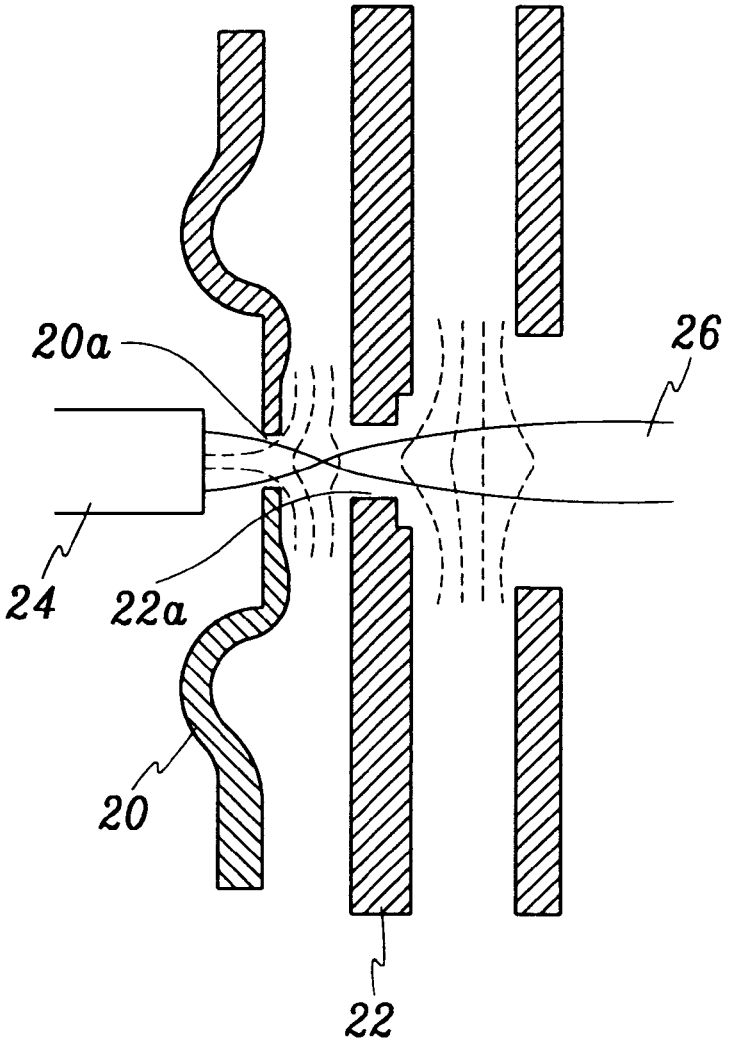
FIG. 3 is a cross-sectional view of an electron gun of a CRT according to a prior art.

FIG. 1 is a schematic sectional view showing a CRT having an electron gun 1 and FIG. 2 is a cross sectional view showing main components of the electron gun 1 of FIG. 1.

As shown in FIG. 1, the CRT is formed with a panel 5 having a phosphor screen 3, a funnel 11 having a neck portion 7, and a deflection yoke 9 placed around the outer periphery of the funnel 11. The electron gun 1 is mounted within the neck portion 7.

The electron gun 1 is formed with a triode portion composed of a cathode 10*a*, a first grid electrode 12*a*, a second grid electrode 14*a*, and other focusing and accelerating electrodes 16*a* and 18*a*.

In operation, the cathode 10*a* is heated to emit thermal electrons. The thermal electrons pass through the first and second grid electrodes 12*a* and 14*a* while forming an electron beam 15. The electron beam 15 is then focused and accelerated through the focusing and accelerating electrodes 16*a* and 18*a* to thereby land on the phosphor screen 3.

With the development of multimedia CRTs, the needs for high resolution and high brightness display characteristics become popular. In order to respond to the needs, the electron beam 15 should land on the phosphor screen 3 by an optimum beam spot size with high current density.

The current density j (r) of the electron beam is defined by the following formula.

$$j(r)=cE_o^{3/2}/d^{1/2}\times(1-r^2/r_0^2)^{3/2} \quad (1)$$

where c is the constant number, $E_o$ is the strength of electric field in the center of the cathode, d is the distance between the cathode and the second grid electrode, $r_o$ is the electron beam emission radius of the cathode, and r is the radius distance from the center of the cathode.

It can be known from the above formula that as the electron emission radius $r_o$ decreases, the current density j becomes smaller.

Therefore, in order to enhance the current density j, the electron beam emission radius $r_o$ should be large. The electron beam emission radius $r_o$ can be given by the following formula.

$$r_o=[R(V_{co}-V_c)/(V_{co}+aV_c)]^{1/2} \quad (2)$$

where R is the radius of the hole of the first grid electrode, $V_{co}$ is the cutoff voltage of the cathode, $V_c$ is the voltage applied to the cathode, and a is the constant number.

The cutoff voltage $V_{co}$ of the cathode can be given by the following formula.

$$V_{co}=k(D^3/G_1t\times G_1G_2\times KG_1)\times EC_2 \quad (3)$$

where k is the constant number, D is the diameter of the hole of the first grid electrode, $G_1t$ is thickness of the hole portion of the first grid electrode, $G_1G_2$ is the distance between the first and second grid electrodes, $KG_1$ is the distance between the cathode and the first grid electrode, and $EC_2$ is the voltage applied to the second grid electrode.

It can be easily known from formulas 2 and 3 that the electron beam emission radius enhances when the hole size of the first grid electrode 12*a* becomes larger, while the thickness of the hole portion of the first grid electrode 12*a* becomes thinner. In addition, the distance between the cathode 10*a* and the first grid electrode 12*a* as well as the distance between the first and second grid electrodes 12*a* and 14*a* should be determined to be relatively wide to enhance the electron emission radius. That is, there is an optimum interrelationship among the components ensuring an adequate electron beam emission radius.

In this preferred embodiment, as shown in FIG. 2, the size of the hole of the first grid electrode 12*a* is determined to be larger than the size of the hole of the second grid electrode 14*a*. Furthermore, the distance between the first and second grid electrodes 12*a* and 14*a* is established to be two or three times the distance between the cathode 10*a* and the first grid electrode 12*a*. With this geometrical structure, the electron beam 15 is crossed over before the focusing electrode 16*a* and, hence, does not fall under the negative influence of the spherical aberration of the main lens to thereby land on the phosphor screen 3 with an optimum spot size.

The crossover of the electron beam is preferably formed between the first and second grid electrodes 12*a* and 14*a*.

In addition, it is preferable that the thickness $t_1$ of the hole portion of the first grid electrode 12*a* is thinner than the thickness $t_2$ of the hole portion of the second electrode 14*a*. The thickness $t_1$ is preferably determined to be less than 0.1 mm.

With the electron gun 1 having the aforementioned structure, the cutoff voltage characteristic of the cathode 10*a* is uniformly kept and the voltage applied to the second grid electrode 14*a* fluently influences the electron beam emission area of the cathode 10*a* to thereby obtain an adequate electron beam emission radius and prevent detrimental change of the produced electron beam size.

As described above, the geometrical structure of the inventive electron gun makes it possible to prevent the detrimental change of the electron beam size and to produce an optimum beam spot size with high current density. Furthermore, in relation to the first grid electrode with a relatively thin hole portion thickness, it can be easily processed with a low cost.

It will be apparent to those skilled in the art that various modifications and variations can be made in the electron gun for the CRT of the present invention without departing from the spirit or scope of the invention. Thus, it is intended that the present invention cover modifications and variations of this invention provided they come within the scope of the appended claims and their equivalents.

What is claimed is:

1. An electron gun for a cathode ray tube, comprising:

a triode portion including a cathode, a first grid electrode and a second grid electrode, each of the first and second grid electrodes having a beam-guide hole, wherein the beam-guide hole of the first grid electrode has a diameter larger than a diameter of the beam-guide hole of the second grid electrode, the first grid electrode adjacent its beam-guide hole has a thickness less than a thickness of the second grid electrode adjacent its beam-guide hole, and a distance between the first grid electrode and the second grid electrode is two to three times greater than a distance between the cathode and the first grid electrode.

2. The electron gun of claim 1 wherein the thickness of the first grid electrode adjacent its beam-guide hole is less than 0.1 mm.

3. The electron gun of claim 1, wherein the cathode emits thermal electrons that pass through the beam-guide holes of the first and second grid electrodes, respectively, and the thermal electrons cross over each other in between the first and second grid electrodes.

4. A cathode ray tube comprising:

a panel;

a phosphor screen;

a funnel connected to the panel, said funnel having a neck portion;

a deflection yoke placed around an outer periphery of the funnel; and an electron gun including a triode portion having a cathode, a first grid electrode and a second grid electrode, each of the first and second grid electrodes having a beam-guide hole, wherein the beam-guide hole of the first grid electrode has a diameter larger than a diameter of the beam-guide hole of the second grid electrode, the first grid electrode adjacent its beam-guide hole has a thickness less than a thickness of the second grid electrode adjacent its beam-guide hole, and a distance between the first grid electrode and the second grid electrode is two or three times greater than a distance between the cathode and the first grid electrode.

5. An electron gun for a cathode ray tube comprising:

a first grid electrode having a first beam-guide hole;

a second grid electrode having a second beam-guide hole and being spaced from the first grid electrode; and a cathode spaced from the first electrode such that the first electrode is located between the cathode and the second grid electrode, the cathode emitting thermal electrons that pass through the beam-guide holes of the first and second grid electrodes, respectively, and the thermal electrons cross over each other in between the first and second grid electrodes, wherein a distance between the first grid electrode and the second grid electrode is two to three times greater than a distance between the cathode and the first grid electrode.

6. The electron gun of claim 5 wherein the first beam-guide hole has a first diameter, and the second beam-guide hole has a second diameter that is smaller than the first diameter.

7. The electron gun of claim 5 wherein the first grid electrode adjacent the first beam-guide hole has a first thickness and the second grid electrode adjacent the second beam-guide hole has a second thickness that is greater than the first thickness.

* * * * *